US012339016B2

(12) United States Patent
McKay

(10) Patent No.: US 12,339,016 B2
(45) Date of Patent: Jun. 24, 2025

(54) POSITIONAL GUIDES FOR SADDLE WINDOW AIR CONDITIONER

(71) Applicant: Haier US Appliance Solutions, Inc., Wilmington, DE (US)

(72) Inventor: Brian Bernard McKay, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 213 days.

(21) Appl. No.: 18/176,105

(22) Filed: Feb. 28, 2023

(65) Prior Publication Data

US 2024/0288182 A1 Aug. 29, 2024

(51) Int. Cl.
*F24F 1/027* (2019.01)
*F24F 1/028* (2019.01)

(52) U.S. Cl.
CPC ..... *F24F 1/027* (2013.01); *F24F 1/028* (2019.02)

(58) Field of Classification Search
CPC .. F24F 1/027; F24F 1/028; F24F 1/031; F24F 1/0314; F24F 13/18; F24F 13/20; F24F 13/32; F24F 13/224; F24F 2221/20
See application file for complete search history.

(56) References Cited

U.S. PATENT DOCUMENTS

| | | | | |
|---|---|---|---|---|
| 7,305,844 | B2 | 12/2007 | Cho et al. | |
| 8,155,797 | B2 | 4/2012 | Wiese | |
| 9,188,352 | B2 | 11/2015 | Wiese | |
| 9,927,138 | B2 | 3/2018 | Wiese | |
| 10,021,809 | B2 | 7/2018 | Lee et al. | |
| 10,101,042 | B2 | 10/2018 | Kim et al. | |
| 10,527,311 | B2 | 1/2020 | Seo et al. | |
| 10,935,257 | B2 | 3/2021 | Jung et al. | |
| 2011/0039490 | A1 | 12/2011 | Wiese | |
| 2020/0124296 | A1* | 4/2020 | Baumann | F24F 1/027 |
| 2021/0164669 | A1 | 6/2021 | Huang | |
| 2021/0222892 | A1 | 7/2021 | Battiese | |
| 2021/0262691 | A1 | 8/2021 | Jang et al. | |
| 2021/0341200 | A1 | 11/2021 | Yang et al. | |

FOREIGN PATENT DOCUMENTS

| | | | |
|---|---|---|---|
| WO | WO2016029532 | A1 | 3/2016 |
| WO | WO2017084371 | A1 | 5/2017 |
| WO | WO2018054042 | A1 | 3/2018 |

(Continued)

OTHER PUBLICATIONS

CN 2118120160 (English Translation) (Year: 2022).*

*Primary Examiner* — Jonathan Bradford
(74) *Attorney, Agent, or Firm* — Dority & Manning, P.A.

(57) ABSTRACT

A saddle window air conditioner includes an indoor module, an outdoor module, and a chaseway extending between the modules. The chaseway includes an outer sleeve having a first end and a second end spaced from the first end, a top wall and a side wall partially defining a cavity, and an inner sleeve having a first end, a second end spaced from the first end, and a top wall, the top wall having a set of alignment guides. The second end of the inner sleeve slides within the cavity to adjust the length of the chaseway between the indoor module and the outdoor module. The modules are parallel when the second end of the outer sleeve aligns with the set of alignment guides.

18 Claims, 7 Drawing Sheets

(56) References Cited

FOREIGN PATENT DOCUMENTS

| | | | |
|---|---|---|---|
| WO | WO2018233142 | A1 | 12/2018 |
| WO | WO2019109395 | A1 | 6/2019 |
| WO | WO2020207099 | A1 | 10/2020 |
| WO | WO2021042190 | A1 | 3/2021 |
| WO | WO2021134896 | A1 | 7/2021 |
| WO | WO2021134899 | A1 | 7/2021 |
| WO | WO2021134902 | A1 | 7/2021 |
| WO | WO2021134903 | A1 | 7/2021 |
| WO | WO2021134932 | A1 | 7/2021 |
| WO | WO2021135431 | A1 | 7/2021 |
| WO | WO2021135600 | A1 | 7/2021 |

* cited by examiner

POSITIONAL GUIDES FOR SADDLE WINDOW AIR CONDITIONER

FIELD OF THE INVENTION

The present subject matter relates generally to window air conditioners, more specifically to saddle window air conditioners.

BACKGROUND OF THE INVENTION

Saddle window air conditioners consist of an indoor module and an outdoor module connected by, and dependent from, a chaseway. The indoor module comprises an indoor coil and a fan, among other things, while the outdoor module comprises an outdoor coil, a compressor and a fan. The chaseway is an enclosed structure connecting the two modules and providing a protected passage for electronic and fluid communication between the two modules. When installed, the chaseway rests on the stool and windowsill with the indoor and outdoor modules on respective sides of the wall below the window and generally extending no further vertically upward than the top of the chaseway. Thus, the window may still provide outward visibility and allow outdoor light to enter the room.

The indoor and outdoor modules may balance, or substantially balance, the weight distribution of saddle window air conditioners, allowing a window to be freely opened when the saddle window air conditioner is installed in the window. Thus, such air conditioners may be used to cool air within a home while optionally allowing the window to be opened to allow fresh air to enter the room. Saddle window air conditioners may also be quieter than other window air conditioners due to the placement of a fan and compressor outside of the cooled room.

Saddle window air conditioners are installed in windows through walls of various thicknesses. Some saddle window air conditioners have a chaseway that is adjustable in length to accommodate the various wall thicknesses. However, properly adjusting the chaseway for the correct wall thickness and maintaining the indoor and outdoor modules in a parallel relationship may be difficult to achieve. Accordingly, improvements to wall thickness adjustment features of saddle air conditioner would be beneficial.

BRIEF DESCRIPTION OF THE INVENTION

Aspects and advantages of the invention will be set forth in part in the following description, may be apparent from the description, or may be learned through practice of the invention.

In one exemplary aspect, a saddle window air conditioner defining mutually perpendicular lateral, vertical, and transverse directions is disclosed. The saddle window air conditioner comprises an indoor module, an outdoor module spaced apart from the indoor module, and a chaseway extending between the indoor module and the outdoor module. The chaseway comprises an outer sleeve having a first end fixedly attached to one of the indoor module and the outdoor module, a second end transversely spaced from the first end, a top wall, and a first side wall, the top wall and first side wall partially defining a cavity, and an inner sleeve having a first end fixedly attached to the other of the indoor module and the outdoor module, a second end transversely spaced from the first end, a first side wall and a top wall, the top wall having a first set of laterally spaced alignment guides, the second end of the inner sleeve slidingly received within the cavity such that a length of the chaseway between the indoor module and the outdoor module is adjustable by transversely sliding the inner sleeve within the outer sleeve. The indoor module and the outdoor module are generally in a parallel configuration when the second end of the outer sleeve aligns with the first set of alignment guides.

In another example aspect, a chaseway for a saddle window air conditioner is disclosed. The chaseway comprises an outer sleeve having a first end and a second end transversely spaced from the first end, a top wall and a first side wall, the top wall and first side wall partially defining a cavity, and an inner sleeve having a first end and a second end transversely spaced from the first end, a first side wall and a top wall, the top wall having a first set of laterally spaced alignment guides, the second end of the inner sleeve slidingly received within the cavity such that a length of the chaseway is adjustable by transversely sliding the inner sleeve within the outer sleeve. In another example aspect, a method of assembling a saddle window air conditioner defining mutually perpendicular lateral, vertical, and transverse directions is disclosed. The saddle window air conditioner comprises an indoor module, an outdoor module, a chaseway comprising an outer sleeve having a first end fixedly attached to one of the indoor module and the outdoor module, a second end transversely spaced from the first end, a top wall and a first side wall, the top wall and first side wall partially defining a cavity. The saddle window air conditioner further comprises an inner sleeve having a first end fixedly attached to the other of the indoor module and the outdoor module, a second end transversely spaced from the first end, a first side wall and a top wall, the top wall having a plurality of sets of laterally spaced alignment guides. The method comprises positioning the indoor module opposite the outdoor module with inner sleeve and outer sleeve aligned; identifying one set of the plurality of sets of alignment guides that corresponds with a predetermined gap between the indoor and outdoor modules; and sliding the inner sleeve into the cavity until the second end of the outer sleeve aligns with the identified set of alignment guides.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
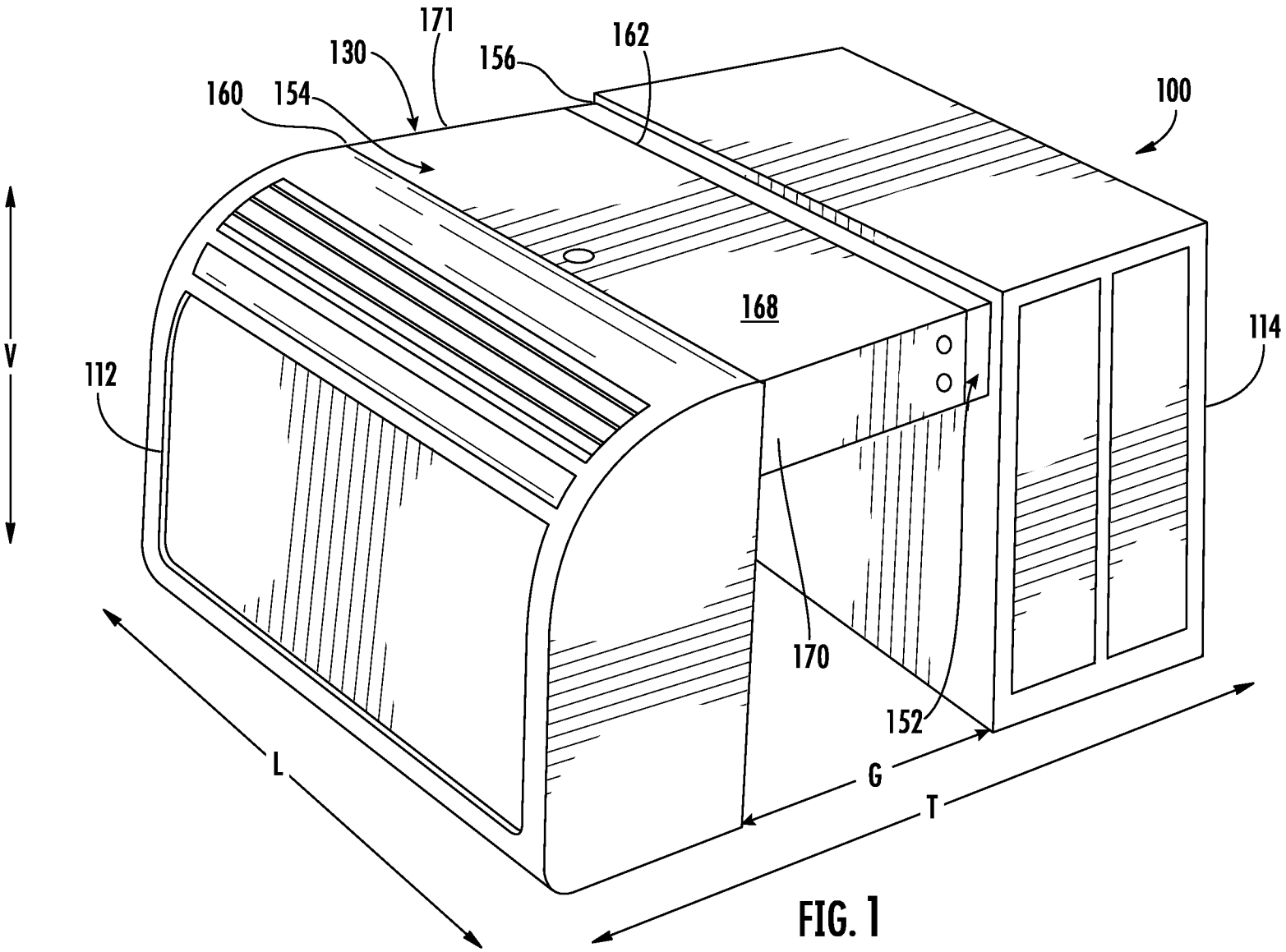
FIG. 1 provides a perspective view of an exemplary saddle window air conditioner according to an embodiment of the present subject matter with the chaseway shown in a retracted configuration.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In general, terms such as "left," "right," "front," "rear," "top," or "bottom" are used with reference to the perspective of a user accessing the indoor module of saddle window air conditioner from the conditioned space.

Figure 2:
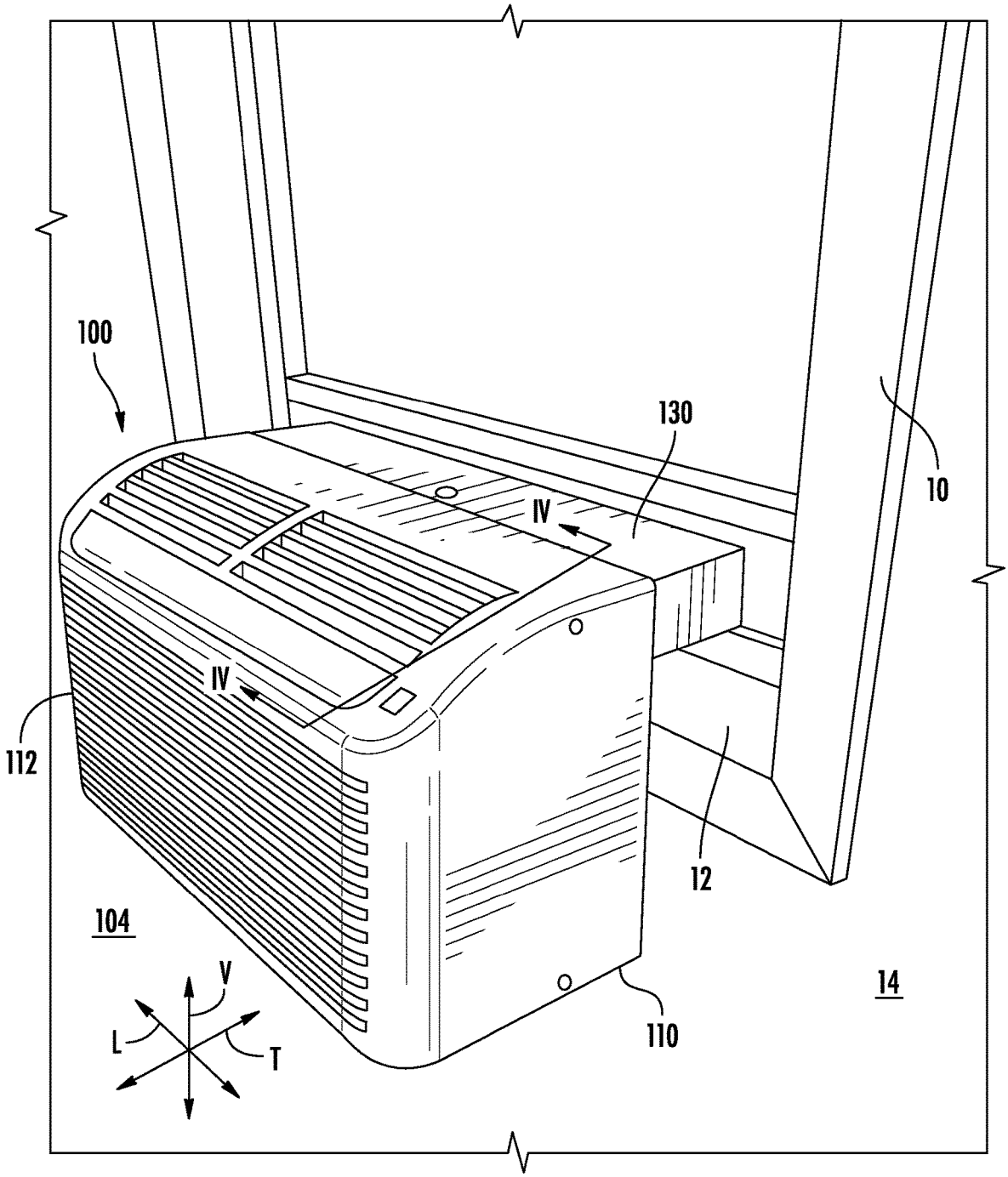
FIG. 2 provides an interior perspective view of the exemplary saddle window air conditioner of FIG. 1 installed in a window.
Figure 3:
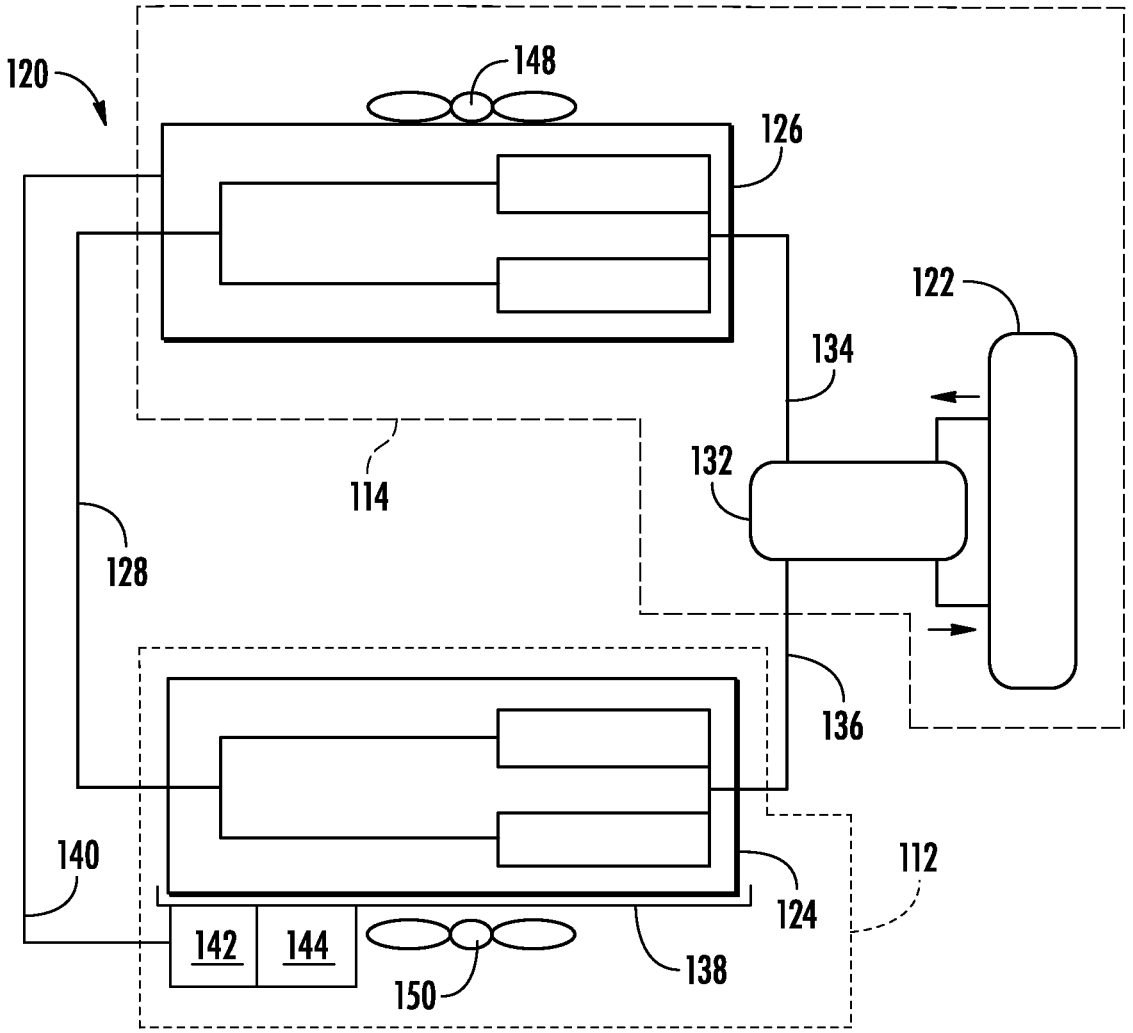
FIG. 3 provides a schematic view of a sealed system of the exemplary saddle window air conditioner of FIG. 1.

Turning to the figures, FIG. 1 provides perspective view of a saddle window air conditioner 100 according to an example embodiment of the present subject matter. In the figure, chaseway 130 is in a retracted configuration (more fully described below) with indoor module 112 and outdoor module 114 spaced apart by gap G, which is at a minimum in this configuration. FIG. 2 is an interior perspective of saddle window air conditioner 100 installed in a window 10. Saddle window air conditioner 100 is operable to generate chilled and/or heated air in order to regulate the temperature of an associated room or building. As will be understood by those skilled in the art, saddle window air conditioner 100 may be installed within window 10 to cool and/or heat air on an interior side of window 10 to a selected temperature. As discussed in greater detail below, saddle window air conditioner 100 includes a sealed system 120 (FIG. 3). Thus, saddle window air conditioner 100 may be a self-contained or autonomous system for heating and/or cooling air. Saddle window air conditioner 100 defines a vertical direction V, a lateral direction L and a transverse direction T that are mutually perpendicular and form an orthogonal direction system.

As used herein, the term "saddle window air conditioner" is used broadly. For example, saddle window air conditioner 100 may include a supplementary electric heater (not shown) for assisting with heating air within the associated room or building without operating the sealed system 120. However, as discussed in greater detail below, saddle window air conditioner 100 may also include a heat pump heating mode that utilizes sealed system 120, with or without an electric resistance heater, to heat air within the associated room or building. Thus, it should be understood that "saddle window air conditioner" as used herein is intended to cover both units with and without heat pump heating modes.

With reference to FIGS. 1 and 2, saddle window air conditioner 100 includes an indoor module 112, an outdoor module 114 and a chaseway 130. Indoor module 112 and outdoor module 114 are spaced apart from each other, e.g., along the transverse direction T. Thus, when installed in window 10, indoor module 112 may be positioned at or contiguous with an interior atmosphere 104 on one side of window 10, and outdoor module 114 may be positioned at or contiguous with an exterior or outdoor atmosphere on the other side of window 10. Chaseway 130 extends between indoor module 112 and outdoor module 114, e.g., through window 10, adjacent to, and at least partially supported by stool 12 on the interior side of the window 10 and the sill (not shown) on the outdoor side of the window 10.

Turning to FIG. 3, sealed system 120 is disposed or positioned within saddle window air conditioner 100, and sealed system 120 includes components for transferring heat between the exterior atmosphere and the interior atmosphere. In particular, various components of sealed system 120 are positioned within indoor module 112 while other components of sealed system 120 are positioned within outdoor module 114.

Saddle window air conditioner 100 further includes a controller (not shown) with user inputs, such as buttons, switches and/or dials. The controller regulates operation of saddle window air conditioner 100. Thus, the controller is in operative communication with various components of saddle window air conditioner 100, such as components of sealed system 120 and/or a temperature sensor (not shown), such as a thermistor or thermocouple, for measuring the temperature of the interior atmosphere 104. In particular, the controller may selectively activate sealed system 120 in order to chill or heat air within sealed system 120, e.g., in response to temperature measurements from the temperature sensor.

The controller includes memory and one or more processing devices such as microprocessors, CPUs or the like, such as general or special purpose microprocessors operable to execute programming instructions or micro-control code associated with operation of saddle window air conditioner 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Sealed system 120, represented schematically in FIG. 3, generally operates in a heat pump cycle. Sealed system 120 includes a compressor 122, an interior heat exchanger or indoor coil 124 and an exterior heat exchanger or outdoor coil 126. As is generally understood, various conduits (e.g., 128, 134, or 136) may be utilized to flow refrigerant between the various components of sealed system 120. Thus, e.g., indoor coil 124 and outdoor coil 126 may be in fluid communication with each other and compressor 122. In general, indoor module 112 and outdoor module 114 may be in fluid communication with each other via various conduits (e.g., 128, 134, or 136) that pass through the chaseway 130.

As may be seen in FIG. 3, sealed system 120 may also include a reversing valve 132. Reversing valve 132 selectively directs compressed refrigerant from compressor 122 to either indoor coil 124 via conduit 136 or to outdoor coil 126 via conduit 134. For example, in a first or cooling mode, reversing valve 132 is arranged or configured to direct compressed refrigerant from compressor 122 to outdoor coil 126. In the cooling mode, outdoor coil 126 is a condenser and indoor coil 124 is an evaporator. Conversely, in a second or heating mode, reversing valve 132 is arranged or configured to direct compressed refrigerant from compressor 122 to indoor coil 124. Consequently, in the heating mode, indoor coil 124 is a condenser and outdoor coil 126 is the evaporator. Thus, reversing valve 132 permits sealed system 120 to adjust between the heating mode and the cooling mode, as will be understood by those skilled in the art.

During operation of sealed system 120 in the cooling mode, refrigerant flows from indoor coil 124 through compressor 122. For example, refrigerant may exit indoor coil 124 as a fluid in the form of a superheated vapor. Upon exiting indoor coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Outdoor coil 126 is disposed downstream of compressor 122 in the cooling mode and acts as a condenser. Thus, outdoor coil 126 is operable to reject heat into the outdoor atmosphere at outdoor module 114 of saddle window air conditioner 100 when sealed system 120 is operating in the cooling mode. For example, the superheated vapor from compressor 122 may enter outdoor coil 126 via a first distribution conduit 134 that extends between and fluidly connects reversing valve 132 and outdoor coil 126. Within outdoor coil 126, the refrigerant from compressor 122 transfers energy to the outdoor atmosphere and condenses into a saturated liquid and/or liquid vapor mixture. An outdoor air handler or outdoor fan 148 is positioned adjacent outdoor coil 126 may facilitate or urge a flow of air from the exterior or outdoor atmosphere across outdoor coil 126 in order to facilitate heat transfer.

Sealed system 120 also includes a capillary tube 128 disposed between indoor coil 124 and outdoor coil 126, e.g., such that capillary tube 128 extends between and fluidly couples indoor coil 124 and outdoor coil 126. Refrigerant, which may be in the form of high liquid quality/saturated liquid vapor mixture, may exit outdoor coil 126 and travel through capillary tube 128 before flowing through indoor coil 124. Capillary tube 128 may generally expand the refrigerant, lowering the pressure and temperature thereof. The refrigerant may then be flowed through indoor coil 124.

Indoor coil 124 is disposed downstream of capillary tube 128 in the cooling mode and acts as an evaporator. For example, the liquid or liquid vapor mixture refrigerant from outdoor coil 126 may enter indoor coil 124 via capillary tube 128 that extends between and fluidly connects indoor coil 124 and outdoor coil 126. Thus, indoor coil 124 is operable to heat refrigerant within indoor coil 124 with energy from the interior atmosphere 104 at indoor module 112 of saddle window air conditioner 100 when sealed system 120 is operating in the cooling mode. Within indoor coil 124, the refrigerant from capillary tube 128 receives energy from the indoor atmosphere 104 and vaporizes into a superheated vapor and/or high quality vapor mixture. An indoor air handler or indoor fan 150 is positioned adjacent indoor coil 124 and may facilitate or urge a flow of air from the interior atmosphere 104 across 104 indoor coil 124 in order to facilitate heat transfer. Indoor fan 150 may be any suitable fan configured to provide a required air flow to achieve the required heat transfer, for example, indoor fan 150 may be a cross-flow fan.

During operation of sealed system 120 in the heating mode, reversing valve 132 reverses the direction of refrigerant flow through sealed system 120. Thus, in the heating mode, indoor coil 124 is disposed downstream of compressor 122 and acts as a condenser, e.g., such that indoor coil 124 is operable to reject heat into the interior atmosphere 104 at indoor module 112 of saddle window air conditioner 100. In addition, outdoor coil 126 is disposed downstream of capillary tube 128 in the heating mode and acts as an evaporator, e.g., such that outdoor coil 126 is operable to heat refrigerant within outdoor coil 126 with energy from the exterior atmosphere at outdoor module 114 of saddle window air conditioner 100.

Indoor coil 124 and indoor fan 150 may be positioned within indoor module 112. Conversely, compressor 122, outdoor coil 126, reversing valve 132 and outdoor fan 148 may be positioned within outdoor module 114. In such a manner, certain noisy components of sealed system 120 may be spaced from the interior atmosphere 104, and saddle window air conditioner 100 may operate quietly. Various fluid passages, such as refrigerant conduits, liquid runoff conduits, etc., may extend through chaseway 130 to fluidly connect components within indoor and outdoor modules 112, 114.

It should be understood that sealed system 120 described above is provided by way of example only. In alternative example embodiments, sealed system 120 may include any suitable components for heating and/or cooling air with a refrigerant. Sealed system 120 may also have any suitable arrangement or configuration of components for heating and/or cooling air with a refrigerant in alternative example embodiments.

As shown in FIG. 3, saddle window air conditioner 100 also includes a drain pan or bottom tray 138. Components of sealed system 120 within indoor module 112 are positioned on bottom tray 138. Thus, liquid runoff from components of sealed system 120 within indoor module 112 may flow into and collect within bottom tray 138. In particular, indoor coil 124 may be positioned over bottom tray 138 along the vertical direction V, and liquid runoff from indoor coil 124, e.g., generated during a defrost of indoor coil 124, may flow downwardly from indoor coil 124 into bottom tray 138. Thus, bottom tray 138 may collect defrost melt water from indoor coil 124 within indoor module 112. As discussed in greater detail below, saddle window air conditioner 100 also includes features for flowing the liquid runoff in bottom tray 138 out of indoor module 112, e.g., and to outdoor module 114.

As shown in FIG. 3, saddle window air conditioner 100 may also include a pump 142 and one or more float switches 144. Pump 142 is coupled to condensate tube 140 and is operable to flow the liquid runoff from indoor coil 124 within bottom tray 138 to outdoor module 114 through condensate tube 140. Float switch 144 is coupled to pump 142 and is operable to activate/deactivate pump 142 in response to a fill level of liquid runoff from indoor coil 124. For example, float switch 144 may be positioned within bottom tray 138, and liquid runoff from indoor coil 124 may flow into bottom tray 138 with float switch 144. As bottom tray 138 fills with liquid runoff from indoor coil 124, float switch 144 trips and activates pump 142 when bottom tray 138 is filled with a predetermined fill level of liquid runoff. In such a manner, liquid runoff from indoor coil 124 may be evacuated from bottom tray 138 by pump 142 when triggered by float switch 144.

Figure 4:
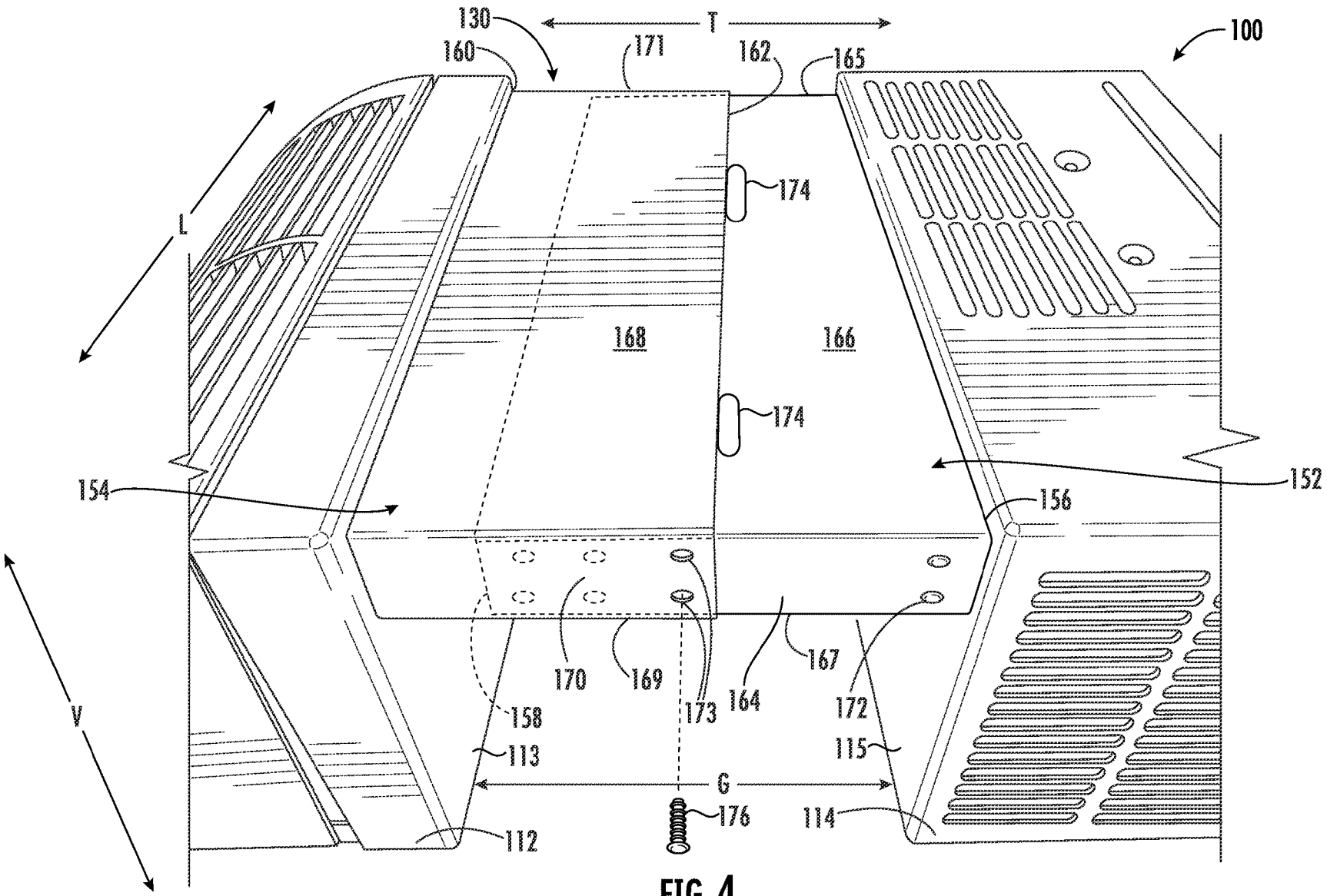
FIG. 4 provides a partial, perspective view of the exemplary saddle window air conditioner of FIG. 1 with the chaseway shown in a first extended configuration.

As shown in FIG. 4, representing a partial perspective view of an exemplary saddle window air conditioner, chaseway 130 comprises an inner sleeve 152 slidingly received within an outer sleeve 154. Generally, a first end 156 of the inner sleeve 152 is fixedly attached to one of the indoor module 112 and the outdoor module 114 and the first end 160 of the outer sleeve 154 is fixedly attached to the other of the inner sleeve 152 and the outer sleeve 154. In the exemplary illustrations, first end 156 of inner sleeve 152 is fixedly attached to outdoor module 114, and a second end 158, transversely spaced from the first end 156, is slidingly received within outer sleeve 154. Also as illustrated, first end 160 of outer sleeve 154 is fixedly attached to the indoor module 112. Second end 160 of outer sleeve 154 is transversely spaced from the first end 160.

In FIG. 4, chaseway 130 is in a first, or partially, extended configuration with indoor and outdoor modules 112, 114 spaced apart by gap G which is greater than in the retracted configuration of FIG. 1. As illustrated in FIG. 4, second end 162 of outer sleeve 154 is spaced apart from first end 156 of inner sleeve 152 in the partial extended configuration while in the retracted configuration of FIG. 1, second end 162 is adjacent to, or abutting, first end 152.

As illustrated, inner sleeve 152 generally comprises a top wall 166 spaced from a bottom wall 167 along the vertical direction V, a first side wall 164 (e.g., the right side when viewed from the indoor module 112) spaced apart from an opposite second side wall 165 (e.g., the left side when viewed from the indoor module 112) along the lateral direction L, and extends from first end 156 to second end 158 along the transverse direction T. As illustrated, the top, bottom, first side, and second side walls 166, 167, 164, 165 of inner sleeve 152 generally extend from first end 156 to second end 158 and are coterminous in the transverse direction T.

As illustrated, the top wall 166 and bottom wall 167 are generally continuous and parallel to each other and mutually perpendicular to generally continuous first and second side walls 164 and 165. As such, inner sleeve 152 is generally formed as having a rectangular cross section. In other embodiments, the cross section may have other shapes or configurations in which one or more walls are discontinuous or one or more walls are not present. For example, in an embodiment, inner sleeve 152 may be formed by top wall 166 and first side wall 164 without a second side wall 165 or bottom wall 167.

Similarly, outer sleeve 154 generally comprises a top wall 168 spaced from a bottom wall 169 along the vertical direction V, a first side wall 170 (e.g., the right side when viewed from the indoor module 112) spaced apart from an opposite second side wall 171 (e.g., the left side when viewed from the indoor module 112) along the lateral direction L, and extends from first end 160 to second end 162 along the transverse direction T. As illustrated, the top wall 166 and bottom wall 167 of outer sleeve 154 are generally continuous and parallel to each other and mutually perpendicular to generally continuous first and second side walls 170 and 171. As such, outer sleeve 154 is generally formed as a rectangular cross section defining an internal cavity. In other embodiments, the cross section may have other shapes or configurations to receive inner sleeve in the cavity for slidable displacement in the transverse T direction. Some embodiments of outer sleeve 154 may include one or more discontinuous walls or may not include one or more walls. For example, the outer sleeve 154 may comprise a top wall 168 and a first side wall 170 that partially define the cavity for receipt of the inner sleeve 152.

Inner sleeve 152 is slidingly received in the cavity formed by outer sleeve 154 and supported for transverse displacement with respect to the outer sleeve 154. Thus, the length of chaseway 130, corresponding to length of gap G, can be adjusted by sliding the inner sleeve 152 with respect to outer sleeve 154. As the indoor and outdoor modules 112, 114 are fixedly attached to the first ends 156, 160 of the inner and outer sleeves 152, 154, respectively, as the inner sleeve 152 moves transversely within outer sleeve 154, the outdoor module 114 moves towards or away from the indoor module 112, shortening or lengthening the gap G and the chaseway 130.

Figure 5:
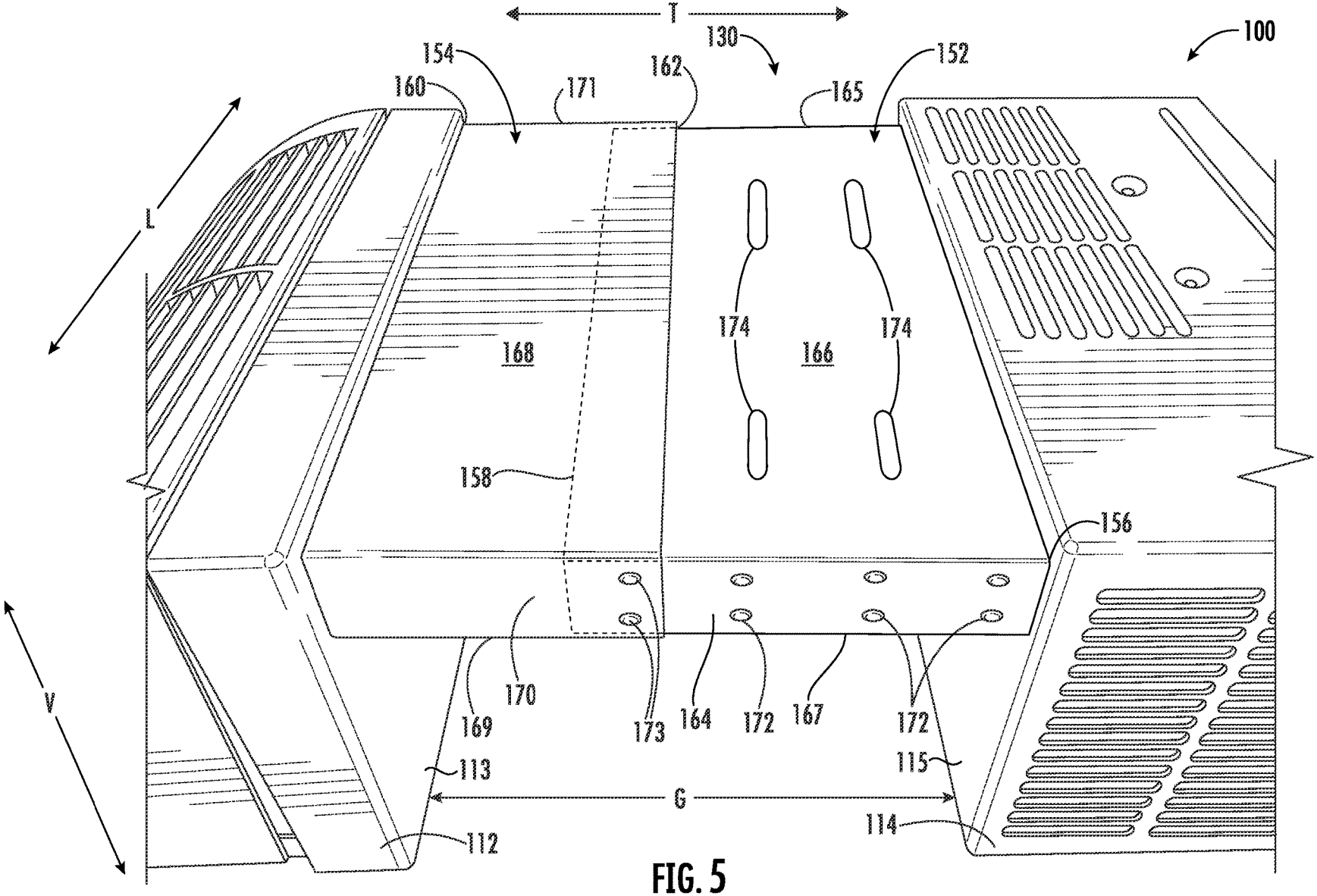
FIG. 5 provides a partial, perspective view of the exemplary saddle window air conditioner of FIG. 1 with the chaseway shown in a second extended configuration.

As may be best illustrated in FIG. 5, first side wall 164 of inner sleeve 152 includes a series of receiving holes 172 formed therethrough. In the exemplary inner sleeve 152 illustrated in the figures, receiving holes 172 are shown as vertically aligned sets or pairs (3 pairs shown) with each pair transversely spaced from the other pairs of receiving holes 172. In other embodiments, the series of receiving holes 172 may be formed in other configurations or differ in number or location. For example, receiving holes 172 may be formed as a pattern of single holes transversely spaced apart. Second side wall 165 of inner sleeve 152 includes a similarly formed series of receiving holes 172 (not shown). Receiving holes 172 may be configured to receive a fastener, for example threaded fastener 176 in a threaded engagement. A portion of the receiving holes 172 may include internal threads, or may provide access to a separate internally threaded element, to facilitate the threaded engagement with the external threads of threaded fastener 176.

In the exemplary embodiment illustrated in FIGS. 4 and 5, first side wall 170 of outer sleeve 154 includes two apertures 173 formed to coaxially align with one pair of receiving holes 172 formed in first side wall 164 of inner sleeve 152 when the inner and outer sleeves 152, 154 are in a predetermined position. The apertures 173, for example clearance holes, align with the receiving holes 172 when the inner sleeve 152 is received into the outer sleeve 154 and displaced in the transverse T direction such that a predetermined gap G is achieved. In other embodiments, one aperture 173 may be formed on first side wall 170 to align with a single receiving hole 172. At different gaps G, apertures 173 may align with different pairs of receiving holes 172.

In some embodiments, a similar configuration is provided on opposite, second side wall 171 of outer sleeve 154 and second side wall 165 of inner sleeve 152. In embodiments, when the apertures 173 on the first side wall 170 and second side wall 171 of outer sleeve 154 align with receiving holes 172 formed in the first and second side walls 164, 165 of inner sleeve 152 respectively, inner module 112 and outer module 114 are generally in a parallel configuration, i.e., gap G is uniform along the lateral direction L. In other embodiments, apertures 173 are located to coaxially align with receiving holes 172 provided in other configurations while maintaining a uniform gap G along the lateral direction L.

In a parallel configuration, the length of the chaseway 130 in the transverse T direction between the first end 156 of the inner sleeve 152 and the first end 160 of the outer sleeve 154 is uniform across the lateral L direction. Accordingly, because the first end 156 of inner sleeve 152 and the first end 160 of outer sleeve 154 are fixedly attached to the indoor module 112 and the outdoor module 114 (or vice versa), in a parallel configuration a portion of L-V planar face 113 of indoor module 112 is parallel to a portion of L-V planar face 115 of outdoor module 114.

Figure 6:
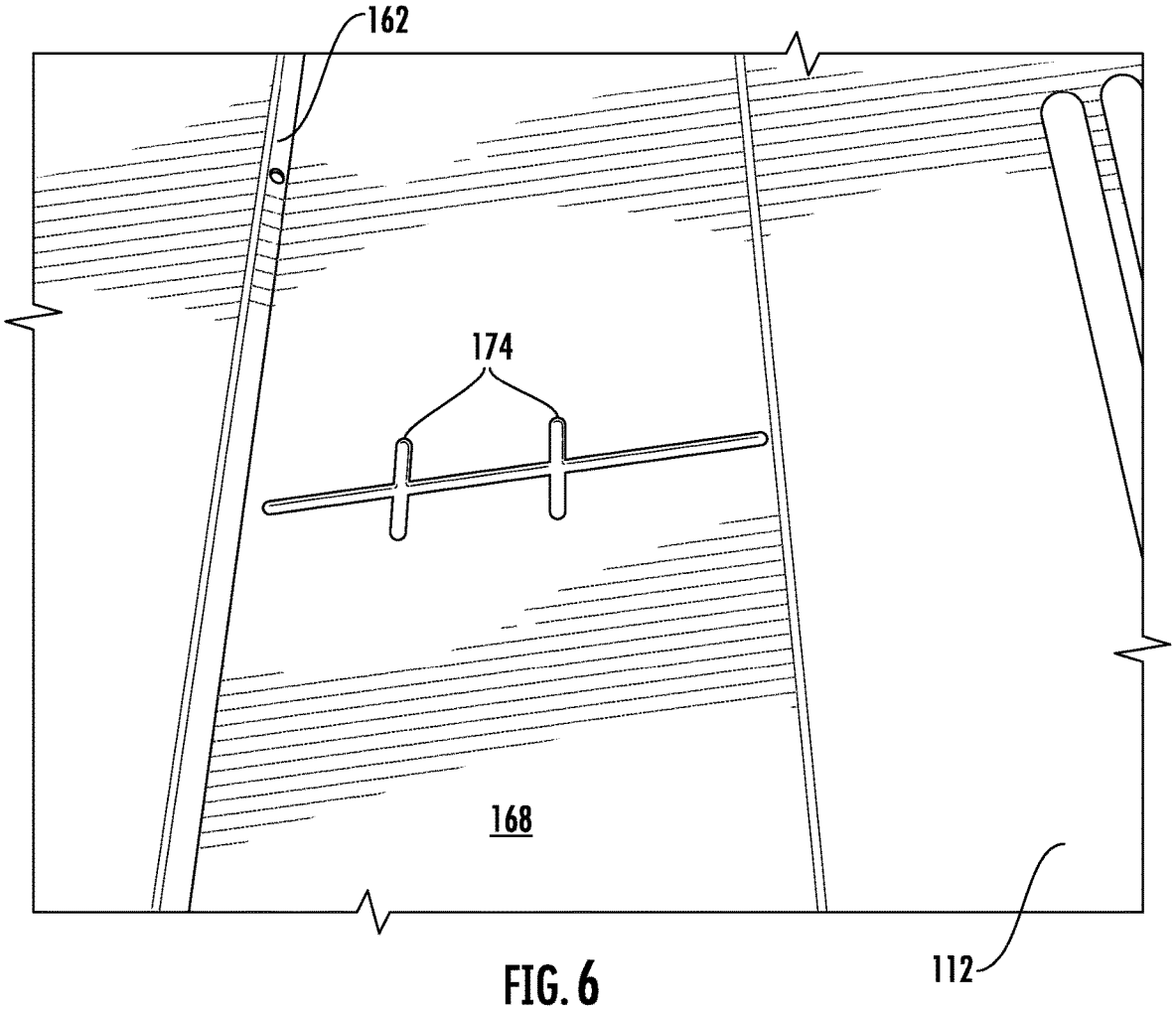
FIG. 6 provides partial view of the top surface of the chaseway showing alignment guides according to an exemplary embodiment of this disclosure.

FIG. 5 represents an exemplary saddle window air conditioner 100 with chaseway 130 in a second extended position, i.e., gap G is greater than in the partially extended configuration of FIG. 4. As may be seen in FIG. 5, top wall 166 of inner sleeve 152 includes a plurality of alignment guides 174. In the exemplary chaseway illustrated, the alignment guides 174 are generally linear details on top wall 166, e.g., extending along the lateral direction L. In embodiments, the alignment guides on top wall 166 may be stamped (embossed or debossed), etched, painted, or otherwise marked to provide at least a visual reference to facilitate placement of indoor and outdoor modules 112, 114 in a parallel orientation (i.e., with a uniform gap G). FIG. 6 is illustrative of a debossed alignment guide in accordance with an embodiment of this disclosure.

As illustrated, alignment guides 174 are provided in sets of two (two sets of two shown), each alignment guide 174 of the set is laterally spaced apart from the other of the set and each alignment guide 174 of the set equidistant transversely from first end 156 of inner sleeve 152. Thus, when inner sleeve 152 is displaced in the transverse direction T within outer sleeve 154 such that second end 162 of outer sleeve 154 is aligned with a set of alignment guides 174, inner module 112 and outer module 114 are in a parallel configuration. Exemplary alignment guides 174 are shown as sets of two alignment elements spaced apart laterally from each other and both of the two equidistant from first end 156. In other embodiments, more than two alignment elements may be used in each set, or only one element, extending substantially across the lateral length L of the inner sleeve 152 and generally parallel to first end 156, may be provided.

In the illustrative embodiment of FIG. 4, when alignment guides 174 are aligned with second end 162 of outer sleeve 154, apertures 173 on first side wall 170 (and second side wall 171 if provided) of outer sleeve 154 are generally coaxial with receiving holes 172 formed on first and second side walls 164, 165 of inner sleeve 152. At least one receiving hole 172 is associated with one set of alignment guides 174. As illustrated in FIG. 4, a set of two alignment guides 174 are aligned with the second end 162 of outer sleeve 154. A vertically aligned set of two apertures 173 is coaxially aligned with an associated set of two receiving holes 172 (hidden by the first side wall 170) such that the receiving holes 172 are positioned to receive a threaded fastener 176 to secure the inner and outer sleeves 152, 154 in a parallel arrangement and restrict or prevent additional relative displacement in the transverse T direction.

One set of receiving holes 172 adjacent to first end 156 of inner sleeve 152 is provided in some embodiments. The set of receiving holes 172 adjacent to first end 156 is not associated with an alignment guide 174. This set of receiving holes 172 may be associated with the retracted position of the chaseway 130 as illustrated in FIG. 1. In the retracted position of the chaseway 130, second end 162 of outer sleeve 154 may be adjacent to first end 156 of inner sleeve 152 or may abut outdoor module 114 to facilitate alignment.

In some embodiments, chaseway 130 is provided with a physical stop (not shown) to resist displacement in the transverse T direction beyond a maximum gap G. For example, the physical stop resists inner sleeve 152 and outer sleeve 154 from separating as the indoor and outdoor modules 112, 114 are moved away from each other. The stop represents the maximum separation of the indoor and outdoor modules 112, 114 and may be associated with one or more receiving holes 172 (two shown) adjacent to second end 158 of inner sleeve 152 (FIG. 4). Accordingly, when gap G is at a maximum, the apertures 173 may be axially aligned with a pair of receiving holes 172. Apertures 173 and corresponding receiving holes 172 may be formed on both the right and left lateral sides of chaseway 130.

Figure 7:
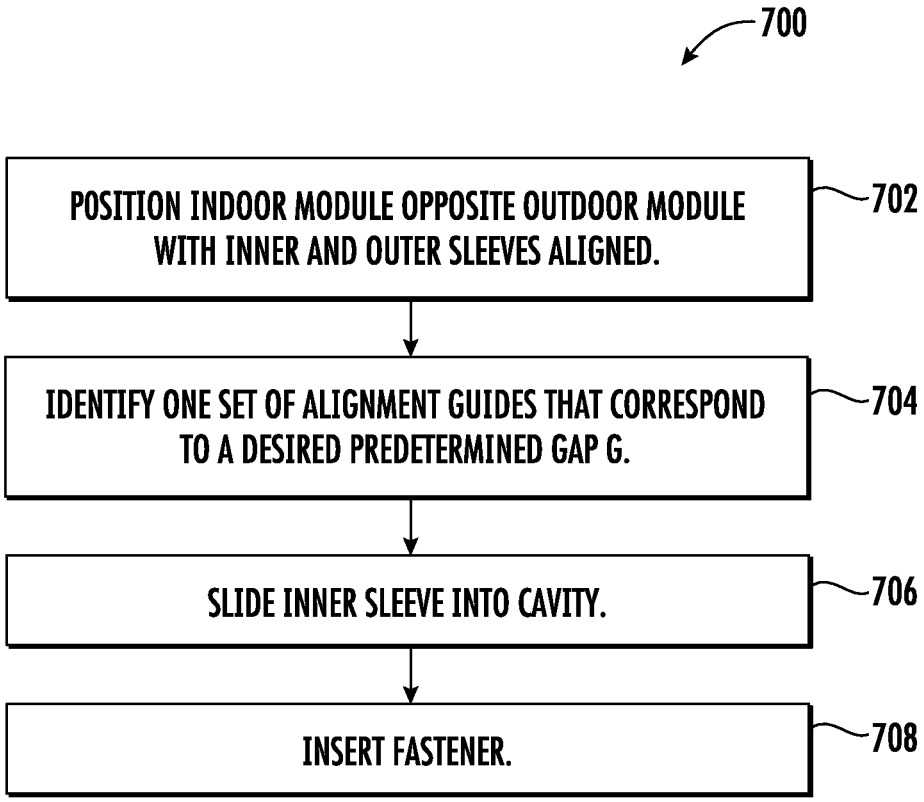
FIG. 7 illustrates a method for assembling a saddle window air conditioner in accordance with an embodiment of the present disclosure.

Now that the construction of a saddle window air conditioner in accordance with this disclosure has been presented, an exemplary method 700 of assembling a saddle window air conditioner will be described with reference to FIG. 7. The saddle window air conditioner 100 defines mutually perpendicular lateral, vertical, and transverse directions. Generally, the saddle window air conditioner 100 comprises an indoor module 112 spaced from and connected to an outdoor module 114 by a chaseway 130. The chaseway 130 includes an outer sleeve 154 having a first end fixedly attached to one of the indoor module and the outdoor module, a second end 162 transversely spaced from the first end, and a top wall and a first side wall 170 partially defining a cavity. The first side wall 170 may include an aperture 173.

The chaseway also includes an inner sleeve 152 having a first end fixedly attached to the other of the indoor module 112 and the outdoor module 114, a second end transversely spaced from the first end, and a first side wall 164 and top wall 166, the top wall including a plurality of sets of alignment guides 174. The first side wall 164 may include a receiving hole 172 configured to accept a threaded fastener 176.

Method 700 begins at 702 with indoor module 112 positioned opposite outdoor module 114 of saddle window air conditioner 100 such that the inner sleeve 152 and the outer sleeve 154 are aligned, i.e., positioned such that the inner sleeve 152 is positioned to be accepted into the cavity partially defined by the top wall 168 and the first side wall 164 of outer sleeve 154.

At 704, one set of the plurality of sets of alignment guides 174 are identified that correspond to a desired predetermined gap G between the indoor and outdoor modules 112, 114. The predetermined gap G is generally selected to be at least as great as the thickness of wall 14 in the transverse direction. As the alignment of the second end 162 of the outer sleeve 154 with alignment guides 174 determines the gap G, identifying one set of the plurality of sets of alignment guides 174 may include identifying the one set of alignment guides 174 that corresponds to a gap G that is closest to, but larger than, the transverse T thickness of wall 14.

At 706, the inner sleeve 152 is received into the outer sleeve 154 and advanced by sliding into the outer sleeve 154 until the second end 162 of the outer sleeve 154 is aligned with the set of alignment guides 174 identified in 704. As the inner sleeve 152 and the outer sleeve 154 are fixedly attached each to one of the indoor and outdoor modules 112, 114, sliding the inner sleeve 152 into the outer sleeve 154 reduces the gap G between the modules. When the second end 162 of outer sleeve 154 aligns with the identified set of alignment guides 174, the predetermined gap G is achieved, the indoor and outdoor modules 112, 114 are in a parallel relationship, and sliding displacement between the inner and outer sleeves 152, 154 ceases.

At 708, when the second end 162 of the outer sleeve 154 is aligned with the identified set of alignment guides 174 that correspond with the predetermined gap G, aperture 173 and receiving hole 172 may be coaxially aligned. In this orientation, a fastener, for example threaded fastener 176, may be inserted through the aperture 173 to engage receiving hole 172. This step may facilitate maintaining the predetermined gap G between the indoor and outdoor modules 112, 114 and maintaining the modules in a parallel relationship. In some embodiments, this step 708 may be optional.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A saddle window air conditioner defining a lateral direction, a vertical direction and a transverse direction, the lateral, vertical, and transverse directions being mutually perpendicular, the saddle window air conditioner comprising:

an indoor module;

an outdoor module spaced apart from the indoor module;

a chaseway extending between the indoor module and the outdoor module, the chaseway comprising:

an outer sleeve having a first end fixedly attached to one of the indoor module and the outdoor module, a second end transversely spaced from the first end, a top wall, and a first side wall, the top wall and first side wall partially defining a cavity; and an inner sleeve having a first end fixedly attached to the other of the indoor module and the outdoor module, a second end transversely spaced from the first end, a first side wall and a top wall, the top wall having a first set of laterally spaced alignment guides, the second end of the inner sleeve slidingly received within the cavity such that a length of the chaseway between the indoor module and the outdoor module is adjustable by transversely sliding the inner sleeve within the outer sleeve, wherein:

the indoor module and the outdoor module are generally in a parallel configuration when the second end of the outer sleeve aligns with the first set of alignment guides;

the first side wall of the outer sleeve defines an aperture formed therethrough and the first side wall of the inner sleeve defines a first receiving hole formed therethrough; and the aperture and the first receiving hole are generally coaxial when the second end of the outer sleeve aligns with the first set of alignment guides.

2. The saddle window air conditioner of claim 1, wherein the first receiving hole is configured to accept a threaded fastener.

3. The saddle window air conditioner of claim 2, further comprising a threaded fastener that passes through the aperture and engages the first receiving hole to substantially prevent transverse displacement of the outer sleeve with respect to the inner sleeve.

4. The saddle window air conditioner of claim 1, wherein the top wall of the inner sleeve further comprises a second set of alignment guides transversely spaced from the first set of alignment guides.

5. The saddle window air conditioner of claim 4, wherein the first side wall of the inner sleeve further defines a second receiving hole transversely spaced from the first receiving hole such that the aperture and the second receiving hole are generally coaxial when the second end of the outer sleeve aligns with the second set of alignment guides.

6. The saddle window air conditioner of claim 5, wherein the second receiving hole is configured to accept a threaded fastener.

7. The saddle window air conditioner of claim 6, further comprising a threaded fastener that passes through the aperture and engages the second receiving hole to substantially prevent transverse displacement of the outer sleeve with respect to the inner sleeve.

8. The saddle window air conditioner of claim 1, wherein the first set of laterally spaced alignment guides are debossed into the top wall of the inner sleeve.

9. The saddle window air conditioner of claim 1, further comprising a sealed system with a fan, an evaporator, a compressor, and a condenser, the fan and the evaporator positioned within the indoor module, the compressor and the condenser positioned within the outdoor module.

10. The saddle window air conditioner of claim 9, wherein the sealed system further comprises a condensate tube within the chaseway, the condensate tube configured to flow liquid runoff from the evaporator to the outdoor module.

11. The saddle window air conditioner of claim 9, wherein the indoor module and the outdoor module are in fluid communication with each other via conduits that pass through the chaseway.

12. A chaseway for a saddle window air conditioner, the chaseway comprising:

an outer sleeve having a first end and a second end transversely spaced from the first end, a top wall and a first side wall, the top wall and first side wall partially defining a cavity; and an inner sleeve having a first end and a second end transversely spaced from the first end, a first side wall and a top wall, the top wall having a first set of laterally spaced alignment guides, the second end of the inner sleeve slidingly received within the cavity such that a length of the chaseway is adjustable by transversely sliding the inner sleeve within the outer sleeve, wherein:

the first side wall of the outer sleeve defines an aperture formed therethrough and the first wall of the inner sleeve defines a first receiving hole formed therethrough; and the aperture and the first receiving hole are generally coaxial when the second end of the outer sleeve aligns with the first set of alignment guides.

13. The chaseway of claim 12, wherein the first receiving hole is configured to accept a threaded fastener, the chaseway further comprising a threaded fastener that passes through the aperture and engages the first receiving hole to substantially prevent transverse displacement of the outer sleeve with respect to the inner sleeve.

14. The chaseway of claim 12, wherein the top wall of the inner sleeve further comprises a second set of alignment guides transversely spaced from the first set of alignment guides.

15. The chaseway of claim 14, wherein the first side wall of the inner sleeve further defines a second receiving hole transversely spaced from the first receiving hole such that the aperture and the second receiving hole are generally coaxial when the second end of the outer sleeve aligns with the second set of alignment guides.

16. The chaseway of claim 15, wherein the second receiving hole is configured to accept a threaded fastener, the chaseway further comprising a threaded fastener that passes through the aperture and engages the second receiving hole to substantially prevent transverse displacement of the outer sleeve with respect to the inner sleeve.

17. A method of assembling a saddle window air conditioner defining a lateral direction, a vertical direction, and a transverse direction, the lateral, vertical, and transverse directions being mutually perpendicular, the saddle window air conditioner comprising:

an indoor module;

an outdoor module; and a chaseway comprising:

an outer sleeve having a first end fixedly attached to one of the indoor module and the outdoor module, a second end transversely spaced from the first end, a top wall and a first side wall, the top wall and first side wall partially defining a cavity, the first side wall of the outer sleeve defining an aperture; and an inner sleeve having a first end fixedly attached to the other of the indoor module and the outdoor module, a second end transversely spaced from the first end, a first side wall and a top wall, the top wall having a plurality of sets of laterally spaced alignment guides, the first side wall of the inner sleeve defining a receiving hole formed therethrough, the method comprising:

positioning the indoor module opposite the outdoor module with inner sleeve and outer sleeve aligned;

identifying one set of the plurality of sets of alignment guides that corresponds with a predetermined gap between the indoor and outdoor modules; and coaxially aligning the aperture and the receiving hole by sliding the inner sleeve into the cavity until the second end of the outer sleeve aligns with the identified set of alignment guides.

18. The method of claim 17, further comprising:

inserting a threaded fastener through the aperture; and engaging the threaded fastener with the receiving hole.

* * * * *